US009240159B2

(12) United States Patent
Na et al.

(10) Patent No.: US 9,240,159 B2
(45) Date of Patent: Jan. 19, 2016

(54) TIMING CONTROLLER AND DISPLAY APPARATUS HAVING THE SAME

(71) Applicant: Samsung Display Co., LTD., Yongin, Gyeonggi-Do (KR)

(72) Inventors: Yeon-Sun Na, Yongin-si (KR); Hyun-Seok Hong, Asan-si (KR); Dong-In Kim, Suwon-si (KR); Ji-Hee Kim, Anyang-si (KR); Kwan-Young Oh, Hwaseong-si (KR); Bum Lee, Cheonan-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 0 days.

(21) Appl. No.: 14/495,132

(22) Filed: Sep. 24, 2014

(65) Prior Publication Data

US 2015/0179131 A1 Jun. 25, 2015

(30) Foreign Application Priority Data

Dec. 23, 2013 (KR) ..... 10-2013-0161601

(51) Int. Cl.
*G09G 5/00* (2006.01)

(52) U.S. Cl.
CPC ..... *G09G 5/006* (2013.01)

(58) Field of Classification Search
CPC ..... G09G 2370/08; G09G 2310/08; H04L 25/0292
See application file for complete search history.

(56) References Cited

U.S. PATENT DOCUMENTS 8,004,486 B2 * 8/2011 Nam ..... G09G 3/3611 345/98
8,384,635 B2 * 2/2013 Weng ..... G09G 3/3688 345/89
8,477,093 B2 7/2013 Nam et al.
2008/0150930 A1 6/2008 Nam et al.
2008/0238895 A1 * 10/2008 Lin ..... G09G 3/20 345/204
2009/0096771 A1 * 4/2009 Lee ..... G09G 3/3611 345/204
2009/0128453 A1 * 5/2009 Moun ..... G09G 3/293 345/60
2009/0244035 A1 * 10/2009 Cho ..... G02F 1/13452 345/204
2009/0251454 A1 * 10/2009 Jang ..... G09G 5/008 345/213

(Continued)

FOREIGN PATENT DOCUMENTS

KR 1020090059217 A 6/2009
KR 1020100073739 A 7/2010

(Continued)

*Primary Examiner* — Jaehwan Oh
(74) *Attorney, Agent, or Firm* — Cantor Colburn LLP

(57) ABSTRACT

A timing controller includes: a top voltage generator configured to output first to third top voltages; a bottom voltage generator configured to output first to third bottom voltages; a first transmitting part configured to output a first data signal for a first data driving chip, based on the first top and bottom voltages; a second transmitting part configured to output a second data signal for a second data driving chip based on the second top and bottom voltages; and a third transmitting part configured to output a third data signal for a third data driving chip based on the third top and bottom voltages, where one of the first to third top voltages is different from another of the first to third top voltages, and one of the first to third bottom voltages is different from another of the first to third bottom voltages.

19 Claims, 12 Drawing Sheets

(56) References Cited

U.S. PATENT DOCUMENTS

2009/0252268 A1* 10/2009 Jang ..... G09G 3/20 375/362
2010/0001981 A1* 1/2010 Chen ..... G09G 3/2092 345/211
2010/0001985 A1* 1/2010 Chen ..... G09G 3/3677 345/214
2010/0156885 A1* 6/2010 Cho ..... G09G 3/006 345/214
2011/0080382 A1 4/2011 Koo
2011/0242088 A1 10/2011 Kim
2012/0274624 A1* 11/2012 Lee ..... G09G 3/3655 345/213
2015/0054798 A1* 2/2015 Park ..... G09G 3/3685 345/204

FOREIGN PATENT DOCUMENTS

KR 1020120065570 A 6/2012
KR 1020120138207 A 12/2012

* cited by examiner

TIMING CONTROLLER AND DISPLAY APPARATUS HAVING THE SAME

This application claims priority to Korean Patent Application No. 10-2013-0161601, filed on Dec. 23, 2013, and all the benefits accruing therefrom under 35 U.S.C. §119, the content of which in its entirety is herein incorporated by reference.

BACKGROUND

1. Field

Exemplary embodiments of the invention relate to a timing controller and a display apparatus having the timing controller. More particularly, exemplary embodiments of the invention relate to a timing controller capable of improving a driving reliability and a display apparatus having the timing controller.

2. Description of the Related Art

Generally, a liquid crystal display ("LCD") apparatus includes a first substrate including a pixel electrode, a second substrate including a common electrode and a liquid crystal layer disposed between the first and second substrate. An electric field is generated by voltages applied to the pixel electrode and the common electrode. By adjusting an intensity of the electric field, a transmittance of a light passing through the liquid crystal layer may be adjusted so that a desired image may be displayed.

Generally, a display apparatus includes a display panel, a panel driver and a timing controller to control the panel driver. The display panel includes a plurality of gate lines and a plurality of data lines. The panel driver includes a gate driver providing gate signals to the gate lines and a data driver providing data voltages to the data lines.

To decrease the width of the bezel, a chip on glass ("COG") method has been employed. In the COG method, a portion of the panel driver or an entire panel driver is mounted on a substrate of the display panel. As a resolution of the display panel increases, the number of data driving chips which are mounted by the chip on glass method increases.

In a structure in which the timing controller and a plurality of the data driving chips are connected in a point-to-point method, distances between the timing controller and the data driving chips may be different from each other.

As a wiring structure between the data driving chip and the timing controller increases, resistance of wire increases. Thus, the data driving chip which is disposed relatively far from the timing controller may require relatively high leveled power.

In contrast, as a wiring structure between the data driving chip and the timing controller decreases, resistance of wire decreases. Thus, the data driving chip which is disposed relatively near from the timing controller may require relatively low leveled power.

Thus, when a relatively high leveled power is applied to the data driving chip to drive the data driving chip which is disposed relatively far from the timing controller, a power consumption increases and a noise is generated.

SUMMARY

One or more exemplary embodiment of the invention provides a timing controller capable of improving a driving reliability.

One or more exemplary embodiment of the invention also provides a display apparatus having the timing controller.

According to an exemplary embodiment, a timing controller includes a top voltage generator, a bottom voltage generator, a first transmitting terminal, a second transmitting terminal and a third transmitting terminal. In such an embodiment, the top voltage generator is configured to output a first top voltage, a second top voltage and a third top voltage, the bottom voltage generator is configured to output a first bottom voltage, a second bottom voltage and a third bottom voltage, the first transmitting part is configured to output a first data signal based on the first top voltage and the first bottom voltage, the first data signal applied to a first data driving chip, the second transmitting part is configured to output a second data signal based on the second top voltage and the second bottom voltage, the second data signal applied to a second data driving chip, and the third transmitting part is configured to output a third data signal based on the third top voltage and the third bottom voltage, the third data signal applied to a third data driving chip. In such an embodiment, one of the first to third top voltages is different from another of the first to third top voltages, and one of the first to third bottom voltages is different from another of the first to third bottom voltages.

In an exemplary embodiment, the top voltage generator may be configured to receive a first input voltage, and the top voltage generator may include a first top voltage transforming part configured to generate the first top voltage based on the first input voltage, a second top voltage transforming part configured to generate the second top voltage based on the first input voltage and a third top voltage transforming part configured to generate the third top voltage based on the first input voltage.

In an exemplary embodiment, the bottom voltage generator may be configured to receive a second input voltage, and the bottom voltage generator may include a first bottom voltage transforming part configured to generate the first bottom voltage based on the second input voltage, a second bottom voltage transforming part configured to generate the second bottom voltage based on the second input voltage and a third bottom voltage transforming part configured to generate the third bottom voltage based on the second input voltage.

In an exemplary embodiment, the top voltage generator may be configured to receive a first input voltage, and the top voltage generator may include a first top voltage transforming part configured to generate the first top voltage and the second top voltage based on the first input voltage and a second top voltage transforming part configured to generate the third top voltage based on the first input voltage, where a level of the first top voltage may be substantially the same as a level of the second top voltage, and a level of the third top voltage may be different from the level of the first top voltage and the level of the second top voltage.

In an exemplary embodiment, the bottom voltage generator may be configured to receive a second input voltage, and the bottom voltage generator may include a first bottom voltage transforming part configured to generate the first bottom voltage and the second bottom voltage based on the second input voltage and a second bottom voltage transforming part configured to generate the third bottom voltage based on the second input voltage, where a level of the first bottom voltage may be substantially the same as a level of the second bottom voltage, and a level of the third bottom voltage may be different from the level of the first bottom voltage and the level of the second bottom voltage.

In an exemplary embodiment, each of the first, second and third top voltage may have a digital value, and each of the first, second and third bottom voltage may have a digital value.

According to an exemplary embodiment, a display apparatus includes a display panel configured to display an image and including a substrate and data lines disposed on the substrate, a timing controller and a data driver configured to provide data voltages to the data lines. In such an embodiment, the timing controller includes a top voltage generator configured to output a first top voltage, a second top voltage and a third top voltage, where one of the first to third top voltages is different from another of the first to third top voltages, a bottom voltage generator configured to output a first bottom voltage, a second bottom voltage and a third bottom voltage, where one of the first to third bottom voltages is different from another of the first to third bottom voltages, a first transmitting terminal configured to output a first data signal based on the first top voltage and the first bottom voltage, a second transmitting terminal configured to output a second data signal based on the second top voltage and the second bottom voltage, and a third transmitting terminal configured to output a third data signal based on the third top voltage and the third bottom voltage. In such an embodiment, the data driver includes a first data driving chip, a second data driving chip and a third data driving chip, where the first data driving chip is disposed on the substrate and is configured to receive the first data signal, the second data driving chip is disposed on the substrate and is configured to receive the second data signal, and the third data driving chip is disposed on the substrate and is configured to receive the third data signal.

In an exemplary embodiment, the top voltage generator may be configured to receive a first input voltage, and the top voltage generator may include a first top voltage transforming part configured to generate the first top voltage based on the first input voltage, a second top voltage transforming part configured to generate the second top voltage based on the first input voltage, and a third top voltage transforming part configured to generate the third top voltage based on the first input voltage.

In an exemplary embodiment, the bottom voltage generator may be configured to receive a second input voltage, and the bottom voltage generator may include a first bottom voltage transforming part configured to generate the first bottom voltage based on the second input voltage, a second bottom voltage transforming part configured to generate the second bottom voltage based on the second input voltage, and a third bottom voltage transforming part configured to generate the third bottom voltage based on the second input voltage.

In an exemplary embodiment, the top voltage generator may be configured to receive a first input voltage, and the top voltage generator may include a first top voltage transforming part configured to generate the first top voltage and the second top voltage based on the first input voltage and a second top voltage transforming part configured to generate the third top voltage based on the first input voltage, where a level of the first top voltage may be substantially the same as a level of the second top voltage, and a level of the third top voltage may be different from the level of the first top voltage and the level of the second top voltage.

In an exemplary embodiment, the bottom voltage generator may be configured to receive a second input voltage, and the bottom voltage generator may include a first bottom voltage transforming part configured to generate the first bottom voltage and the second bottom voltage based on the second input voltage and a second bottom voltage transforming part configured to generate the third bottom voltage based on the second input voltage, where a level of the first bottom voltage may be substantially the same as a level of the second bottom voltage, and a level of the third bottom voltage may be different from the level of the first bottom voltage and the level of the second bottom voltage.

In an exemplary embodiment, the display apparatus may further include a first wire configured to electrically connect the first transmitting terminal to the first data driving chip, a second wire configured to electrically connect the second transmitting terminal to the second data driving chip, and a third wire configured to electrically connect the third transmitting terminal to the third data driving chip, where a length of the first wire may be substantially the same as a length of the second wire, and a length of the third wire may be different from the length of the first wire.

In an exemplary embodiment, each of the first, second and third top voltage may have a digital value, and each of the first, second and third bottom voltage may have a digital value.

According to an exemplary embodiment, a display apparatus includes a display panel configured to display an image and including a substrate and data lines disposed on the substrate, a timing controller and a data driver configured to provide data voltages to the data lines. In such an embodiment, the timing controller includes a first top voltage generator configured to output a first top voltage, a second top voltage generator configured to output a second top voltage having a different level from the first top voltage, a first bottom voltage generator configured to output a first bottom voltage, a second bottom voltage generator configured to output a second bottom voltage having a different level from the first bottom voltage, a first transmitting terminal configured to output a first data signal based on the first top voltage and the first bottom voltage and a second transmitting terminal configured to output a second data signal based on the second top voltage and the second bottom voltage. In such an embodiment, the data driver includes a first data driving chip and a second data driving chip to provide data voltages to the data lines, where the first data driving chip is disposed on the substrate and is configured to receive the first data signal, and the second data driving chip is disposed on the substrate and is configured to receive the second data signal.

In an exemplary embodiment, the data driver may further include a third data driving chip disposed on the substrate and configured to output the data voltages to the data lines, and the timing controller may further include a third transmitting terminal configured to output a third data signal to the third data driving chip.

In an exemplary embodiment, the timing controller may further include a third top voltage generator configured to output a third top voltage, and a third bottom voltage generator configured to output a third bottom voltage, where the third transmitting terminal may be configured to output the third data signal to the third data driving chip based on the third top voltage and the third bottom voltage.

In an exemplary embodiment, the third transmitting terminal may be configured to output the third data signal to the third data driving chip based on the first top voltage and the first bottom voltage.

In an exemplary embodiment, the display apparatus may further include a first wire configured to electrically connect the first transmitting terminal to the first data driving chip, a second wire configured to electrically connect the second transmitting terminal to the second data driving chip, and a third wire configured to electrically connect the third transmitting terminal to the third data driving chip, where a length of the first wire may be substantially the same as a length of the third wire, and a length of the second wire may be different from the length of the first wire.

In an exemplary embodiment, each of the first and second top voltage may have a digital value, and each of the first and second bottom voltage may have a digital value.

According to one or more exemplary embodiment of the timing controller and the display apparatus including the timing controller, the timing controller may provide powers corresponding to data driving chips, independently of each other. Thus, in such embodiments, power consumption decreases, noise decreases and driving reliability is improved. In such embodiments, as the noise decreases, the display quality of a display apparatus may be improved.

BRIEF DESCRIPTION OF THE DRAWINGS

The above and other features of the invention will become more apparent by describing in detailed exemplary embodiments thereof with reference to the accompanying drawings, in which.

DETAILED DESCRIPTION

Figure 1:
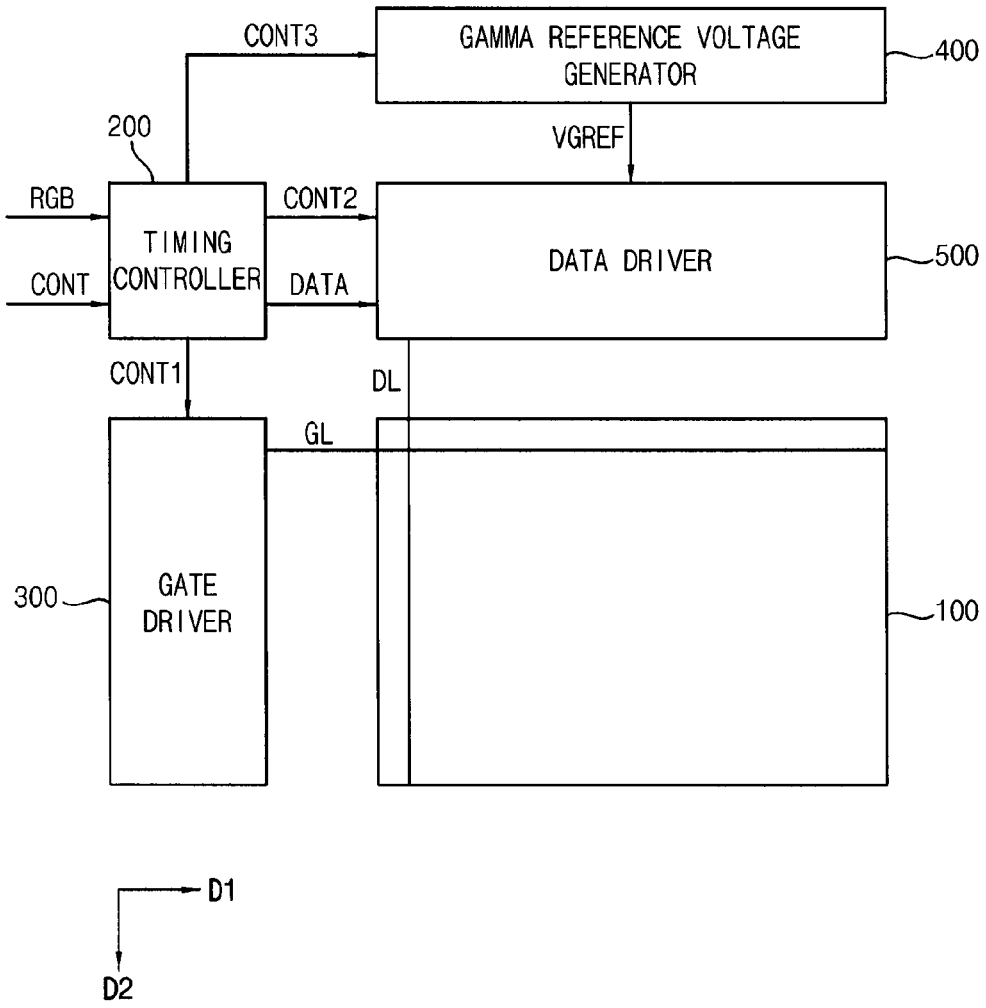
FIG. 1 is a block diagram illustrating an exemplary embodiment of a display apparatus according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Hereinafter, exemplary embodiments of the invention will be described in detail with reference to the accompanying drawings.

FIG. 1 is a block diagram illustrating an exemplary embodiment of a display apparatus according to the invention.

Referring to FIG. 1, an exemplary embodiment of the display apparatus includes a display panel 100 and a panel driver. The panel driver includes a timing controller 200, a gate driver 300, a gamma reference voltage generator 400 and a data driver 500.

The display panel 100 displays an image. The display panel 100 has a display region, on which an image is displayed, and a peripheral region adjacent to the display region.

The display panel 100 includes a plurality of gate lines GL, a plurality of data lines DL and a plurality of unit pixels connected to the gate lines GL and the data lines DL. The gate lines GL extend substantially in a first direction D1 and the data lines DL extend substantially in a second direction D2 crossing the first direction D1.

Each unit pixel includes a switching element (not shown), a liquid crystal capacitor (not shown) and a storage capacitor (not shown). The liquid crystal capacitor and the storage capacitor are electrically connected to the switching element. The unit pixels may be disposed substantially in a matrix configuration.

The timing controller 200 receives input image data RGB and an input control signal CONT from an external apparatus (not shown). The input image data RGB may include red image data, green image data and blue image data. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3 and a data signal DATA based on the input image data RGB and the input control signal CONT.

The timing controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The timing controller 200 generates the data signal DATA based on the input image data RGB. The timing controller 200 outputs the data signal DATA to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals for driving the gate lines GL in response to the first control signal CONT1 received from the timing controller 200. The gate driver 300 sequentially outputs the gate signals to the gate lines GL.

In an exemplary embodiment, the gate driver 300 may be directly disposed, e.g., mounted, on the display panel 100, or may be connected to the display panel 100 as a tape carrier package ("TCP") type. Alternatively, the gate driver 300 may be integrated on the peripheral region of the display panel 100.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

The gamma reference voltage generator 400 may be disposed in the timing controller 200 or in the data driver 500.

The data driver 500 receives the second control signal CONT2 and the data signal DATA from the timing controller 200, and receives the gamma reference voltages VGREF from the gamma reference voltage generator 400. The data driver 500 converts the data signal DATA into analog data voltages using the gamma reference voltages VGREF. The data driver 500 outputs the data voltages to the data lines DL.

In an exemplary embodiment, the data driver 500 includes a plurality of data driving chips. The data driving chips are disposed, e.g., mounted, on the display panel 100. In one exemplary embodiment, for example, the data driving chips may be mounted on a substrate on which the gate line GL and the data line DL are disposed.

In an alternative exemplary embodiment, the data driver 500 may be connected to the display panel 100 as a TCP type. In another alternative exemplary embodiment, the data driver 500 may be integrated on the peripheral region of the display panel 100.

Figure 2:
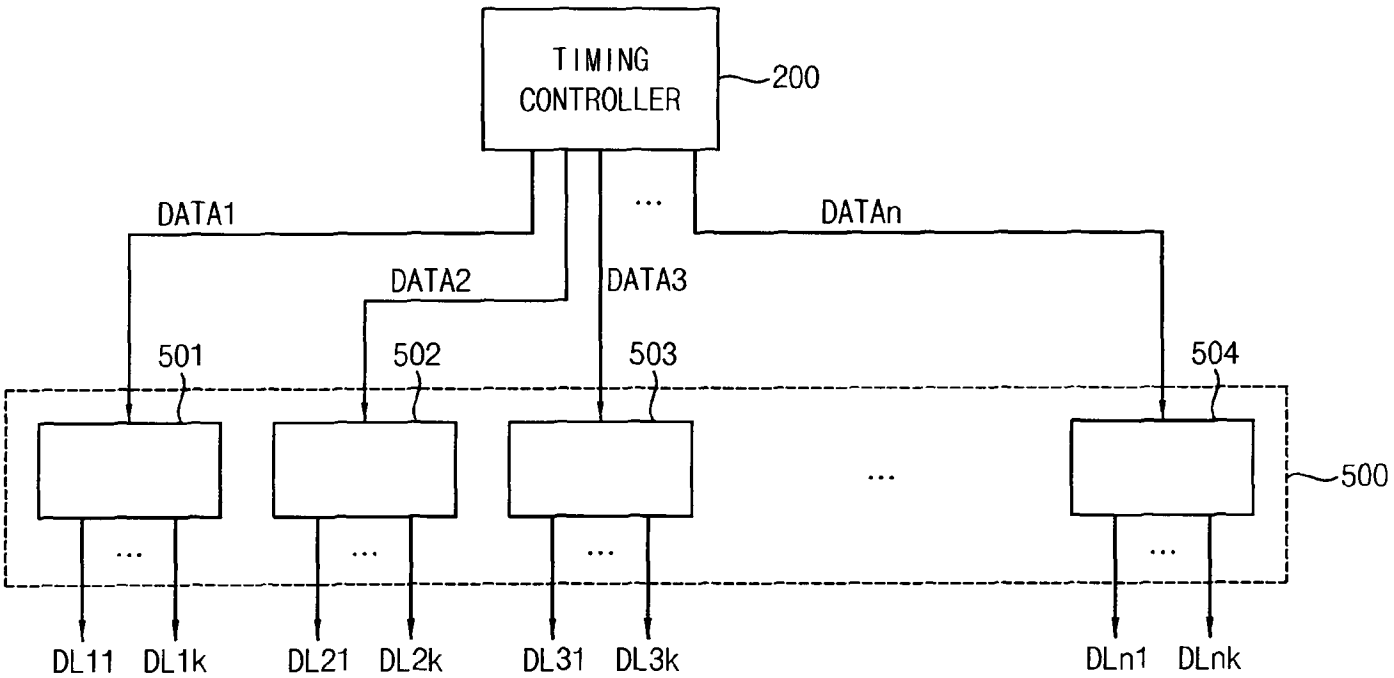
FIG. 2 is a block diagram illustrating an exemplary embodiment of a timing controller and a data driver of FIG. 1.

FIG. 2 is a block diagram illustrating an exemplary embodiment of a timing controller and a data driver of FIG. 1.

Referring to FIGS. 1 and 2, an exemplary embodiment of the data driver 500 includes a plurality of data driving chips, e.g., a first data driving chip 501, a second data driving chip 502, a third data driving chip 503 to an n-th data driving chip 504 (here, n is a natural number).

The number of the data driving chips in the data driver 500 may be the same as the number of the data lines. Each of the data driving chips is connected to the data lines and outputs the data voltage to the data lines.

In one exemplary embodiment, for example, the first data driving chip 501 may be connected to the data lines from a first data line DL11 to a k-th data line DL1*k*, the second data driving chip 502 may be connected to the data lines from a (k+1)-th data line DL21 to a 2k-th data line DL2*k*, the third data driving chip 503 may be connected to the data lines from a (2k+1)-th data line DL31 to a 3k-th data line DL3*k*, and the n-th data driving chip 504 may be connected to the data lines from an (nk-k+1)-th data line DLn1 to an nk-th data line Dnk (here, k is a natural number).

The data signal DATA received from the timing controller 200 may include a first data signal DATA1, a second data signal DATA2, a third data signal DATA3 to an n-th data signal DATAn.

The first data driving chip 501 may receive the first data signal DATA1. The second data driving chip 502 may receive the second data signal DATA2. The third data driving chip 503 may receive the third data signal DATA3. The n-th data driving chip 504 may receive the n-th data signal DATAn. Each of the first to n-th data signals may be a digital signal.

Figure 3:
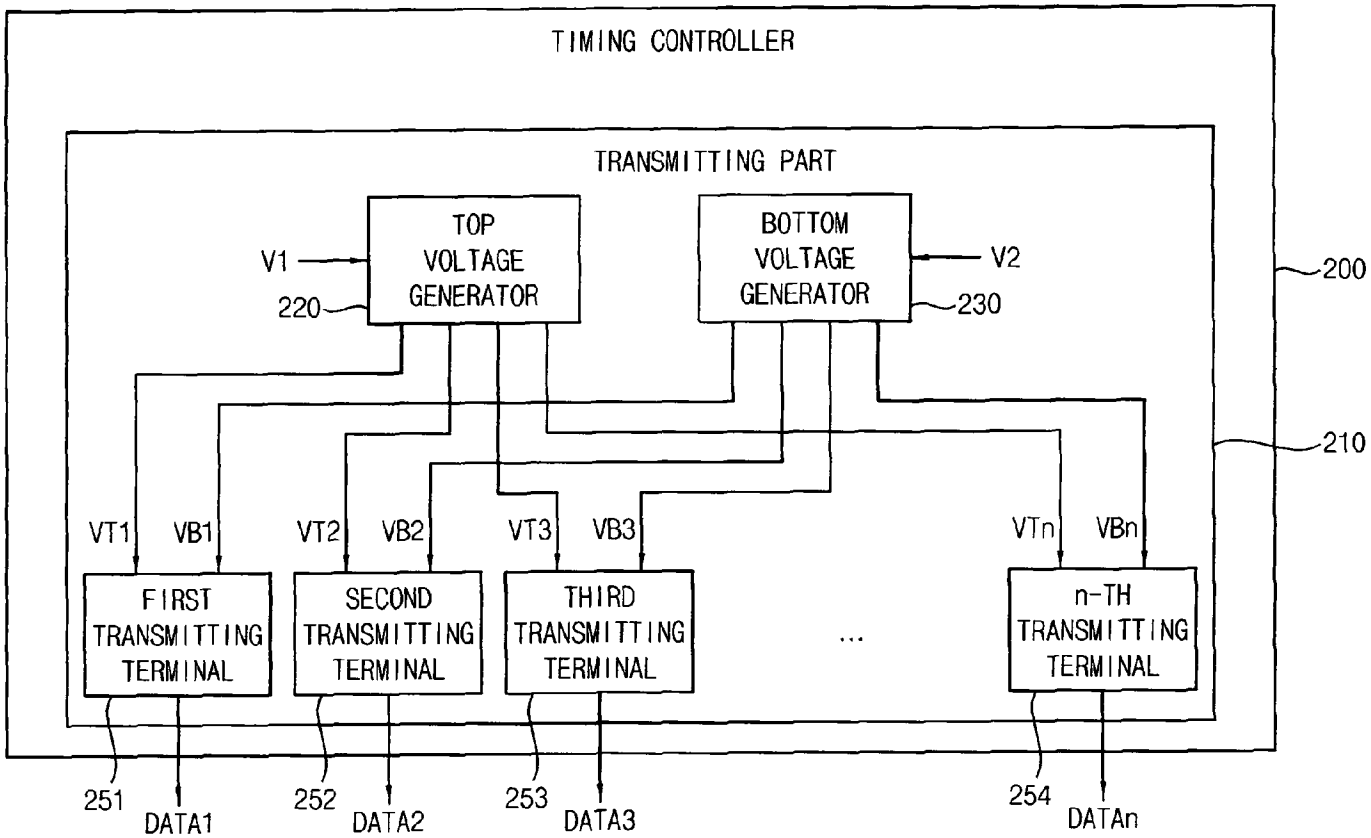
FIG. 3 is a block diagram illustrating an exemplary embodiment of a timing controller of FIG. 2.
Figure 4:
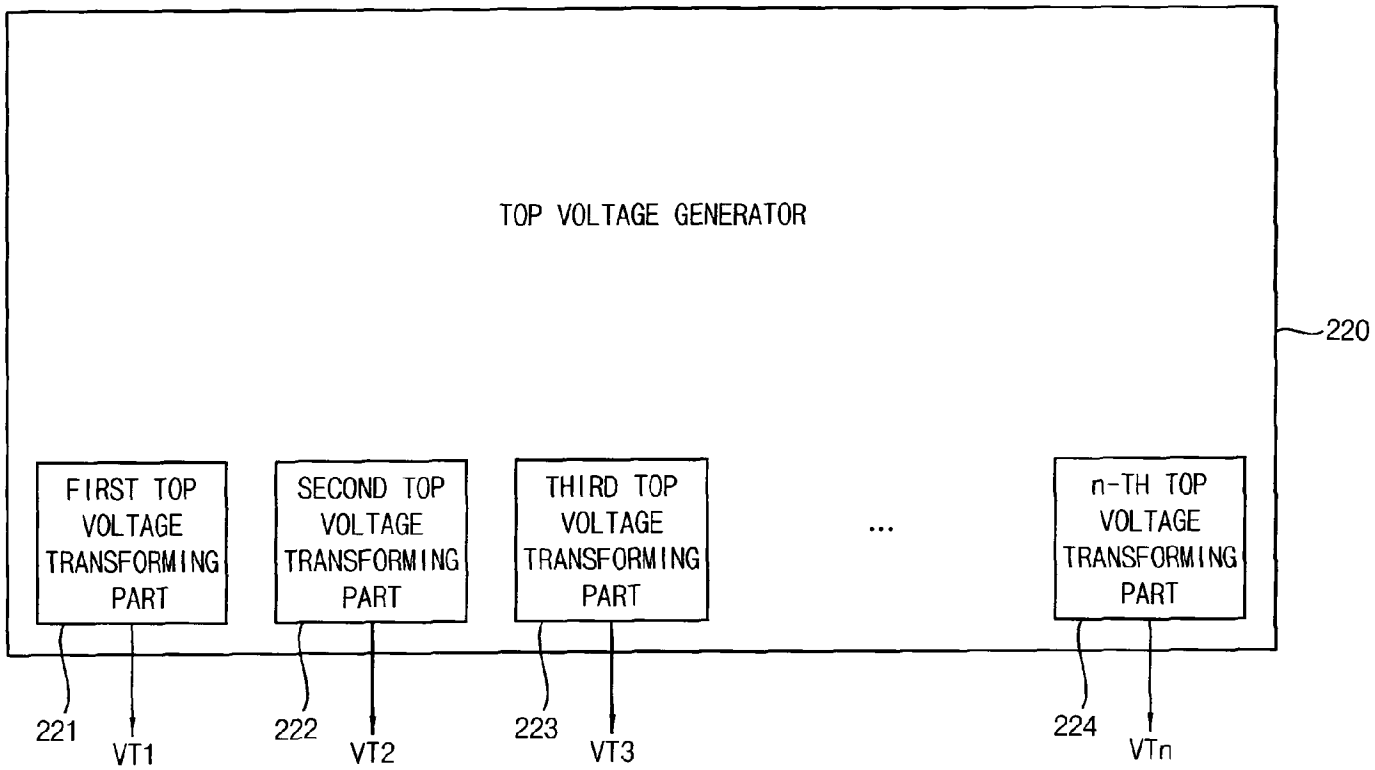
FIG. 4 is a block diagram illustrating an exemplary embodiment of a top voltage generator of FIG. 3.
Figure 5:
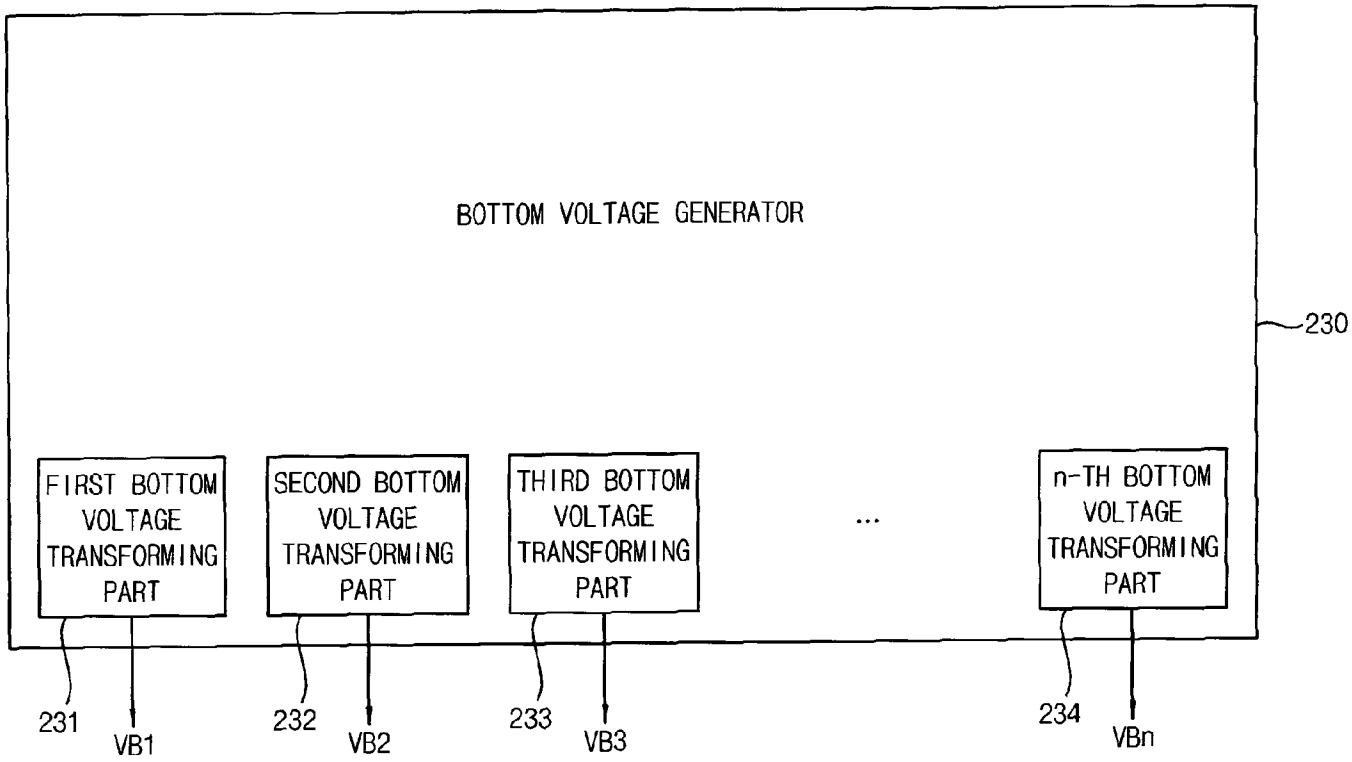
FIG. 5 is a block diagram illustrating an exemplary embodiment of a bottom voltage generator of FIG. 3.

FIG. 3 is a block diagram illustrating an exemplary embodiment of a timing controller of FIG. 2. FIG. 4 is a block diagram illustrating an exemplary embodiment of a top voltage generator of FIG. 3. FIG. 5 is a block diagram illustrating an exemplary embodiment of a bottom voltage generator of FIG. 3.

Referring to FIGS. 1 to 5, an exemplary embodiment of the timing controller 200 includes a transmitting part 210.

The transmitting part 210 may include a top voltage generator 220, a bottom voltage generator 230, a first transmitting terminal 251, a second transmitting terminal 252 and a third transmitting terminal 253 to an n-th transmitting terminal 254. In an exemplary embodiment, the transmitting part 210 may be connected to the data driving chips of the data driver 500 in a point-to-point method. Thus, in such an embodiment, the number of transmitting terminals in the transmitting part 210 is the same as the data driving chips.

The first transmitting terminal 251 may generate the first data signal DATA1 based on a first top voltage VT1 and a first bottom voltage VB1. The first transmitting terminal 251 may output the first data signal DATA1 to the first data driving chip 501.

The second transmitting terminal 252 may generate the second data signal DATA2 based on a second top voltage VT2 and a second bottom voltage VB2. The second transmitting terminal 252 may output the second data signal DATA2 to the second data driving chip 502.

The third transmitting terminal 253 may generate the third data signal DATA3 based on a third top voltage VT3 and a third bottom voltage VB3. The third transmitting terminal 253 may output the third data signal DATA3 to the third data driving chip 503.

The n-th transmitting terminal 254 may generate the n-th data signal DATAn based on an n-th top voltage VTn and an n-th bottom voltage VBn. The n-th transmitting terminal 254 may output the n-th data signal DATAn to the n-th data driving chip 504.

In an exemplary embodiment, the top voltage generator 220 may include a first top voltage transforming part 221, a second top voltage transforming part 222, a third top voltage transforming part 223 to an n-th top voltage transforming part 224. The first to n-th top voltage transforming parts 221 to 224 may be connected to the first to n-th transmitting terminals 251 to 254, respectively. Thus, the number of the top voltage transforming parts in the top voltage generator 220 is the same as the transmitting terminals.

The top voltage generator 220 may receive a first input voltage V1 from a power supplier (not shown). The top voltage generator 220 may generate and output the first top voltage VT1, the second top voltage VT2, the third top voltage VT3 to the n-th top voltage VTn based on the first input voltage V1.

In one exemplary embodiment, for example, the first top voltage transforming part 221 may generate the first top voltage VT1 based on the first input voltage V1, and output the first top voltage VT1 to the first transmitting terminal 251. The second top voltage transforming part 222 may generate the second top voltage VT2 based on the first input voltage V1, and output the second top voltage VT2 to the second transmitting terminal 252. The third top voltage transforming part 223 may generate the third top voltage VT3 based on the first input voltage V1, and output the third top voltage VT3 to the third transmitting terminal 253. The n-th top voltage transforming part 224 may generate the n-th top voltage VTn based on the first input voltage V1, and output the n-th top voltage VTn to the n-th transmitting terminal 254.

In an exemplary embodiment, levels of the first to n-th top voltages VT1 to VTn may be different from each other. In an exemplary embodiment, each of the first to n-th top voltages VT1 to VTn may have a digital value corresponding to a level thereof.

In an exemplary embodiment, the bottom voltage generator 230 may include a first bottom voltage transforming part 231, a second bottom voltage transforming part 232, a third bottom voltage transforming part 233 to an n-th bottom voltage transforming part 234. The first to n-th bottom voltage transforming parts 231 to 234 may be connected to the first to n-th transmitting terminals 251 to 254, respectively. Thus, the number of bottom voltage transforming parts in the bottom voltage generator 230 is the same as the number of the transmitting terminals.

The bottom voltage generator 230 may receive a second input voltage V2 from the power supplier. The bottom voltage generator 230 may generate and output the first bottom voltage VB1, the second bottom voltage VB2, the third bottom voltage VB3 to n-th bottom voltage VBn based on the second input voltage V2.

In one exemplary embodiment, for example, the first bottom voltage transforming part 231 may generate the first bottom voltage VB1 based on the second input voltage V2, and output the first bottom voltage VB1 to the first transmitting terminal 251. The second bottom voltage transforming part 232 may generate the second bottom voltage VB2 based on the second input voltage V2, and output the second bottom voltage VB2 to the second transmitting terminal 252. The third bottom voltage transforming part 233 may generate the third bottom voltage VB3 based on the second input voltage V2, and output the third bottom voltage VB3 to the third transmitting terminal 253. The n-th bottom voltage transforming part 234 may generate the n-th bottom voltage VBn based on the second input voltage V2, and output the n-th bottom voltage VBn to the n-th transmitting terminal 254.

In an exemplary embodiment, levels of the first to n-th bottom voltages VB1 to VBn may be different from each other. In an exemplary embodiment, each of the first to n-th bottom voltages VB1 to VBn may have a digital value corresponding to a level thereof.

Hereinafter, an alternative exemplary embodiment of a display apparatus will be described with reference to FIGS. 1, 2 and 6 to 9.

Figure 6:
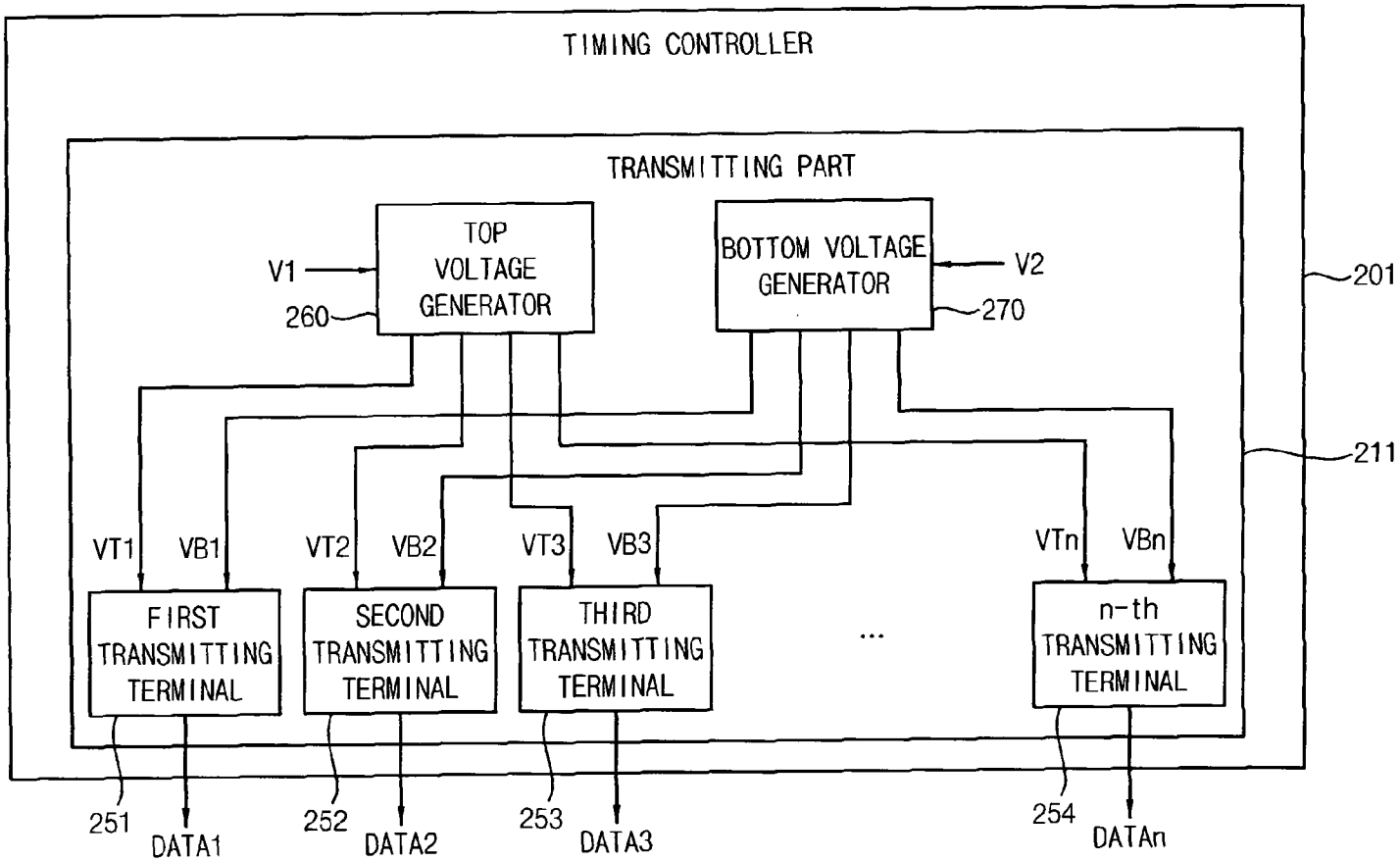
FIG. 6 is a block diagram illustrating an alternative exemplary embodiment of a timing controller according to the invention.
Figure 7:
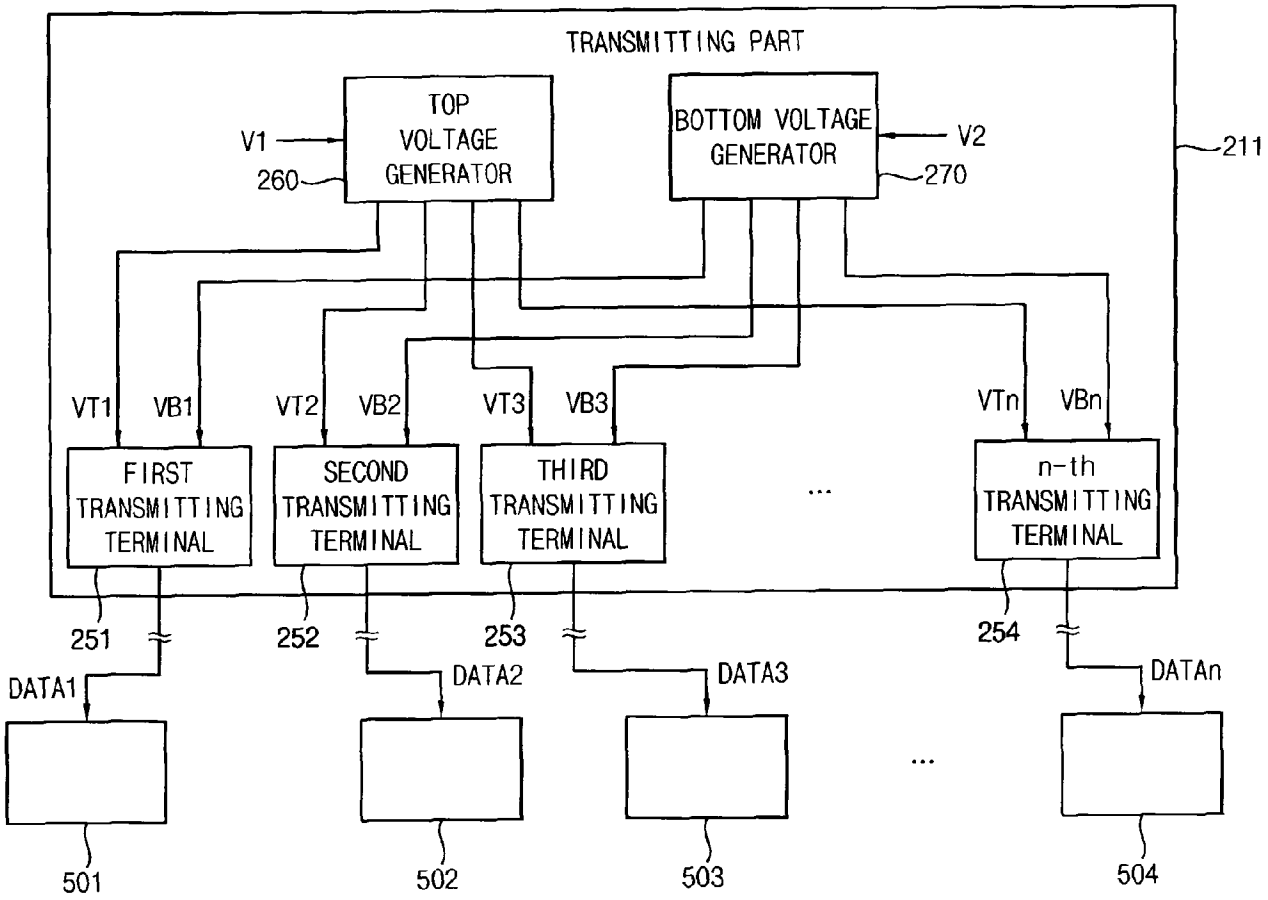
FIG. 7 is a block diagram illustrating an exemplary embodiment of a data driver and a transmitting part of FIG. 6.
Figure 8:
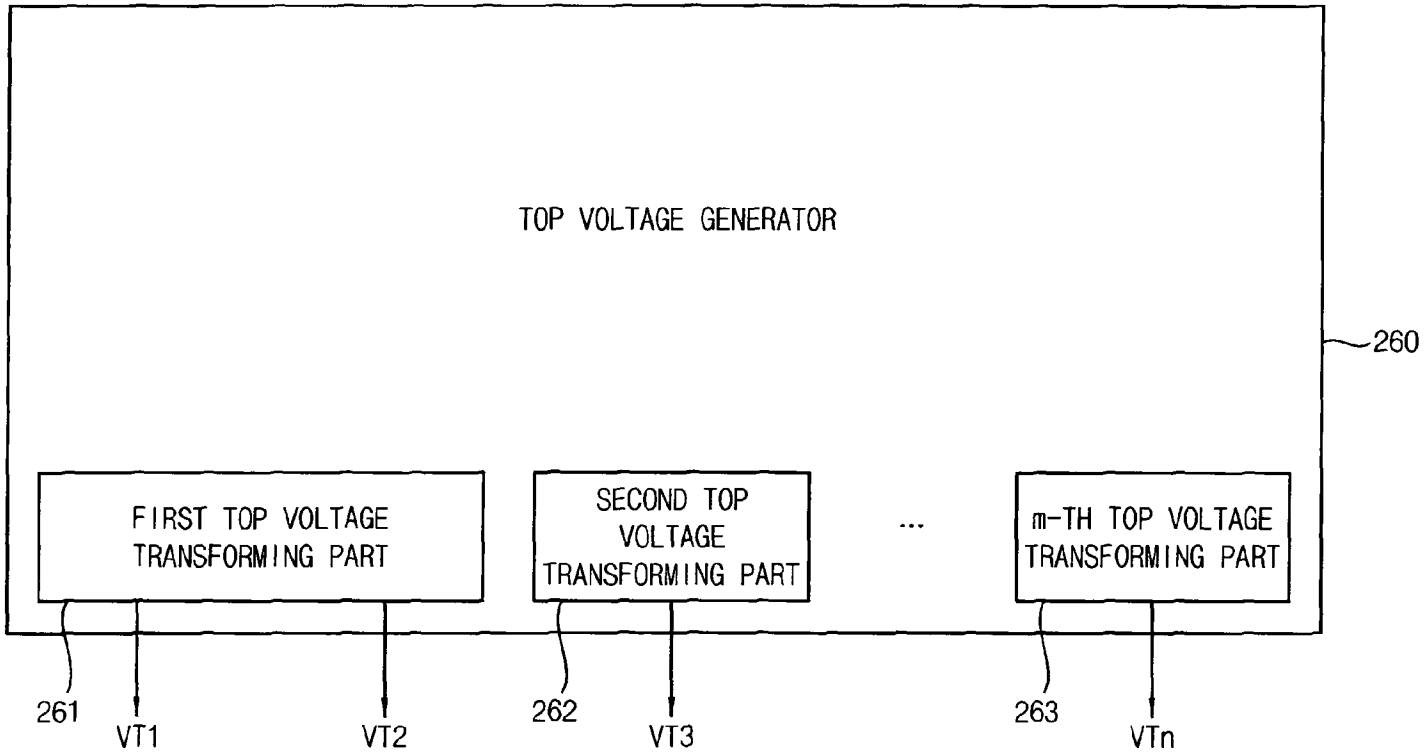
FIG. 8 is a block diagram illustrating an exemplary embodiment of a top voltage generator of FIG. 7.
Figure 9:
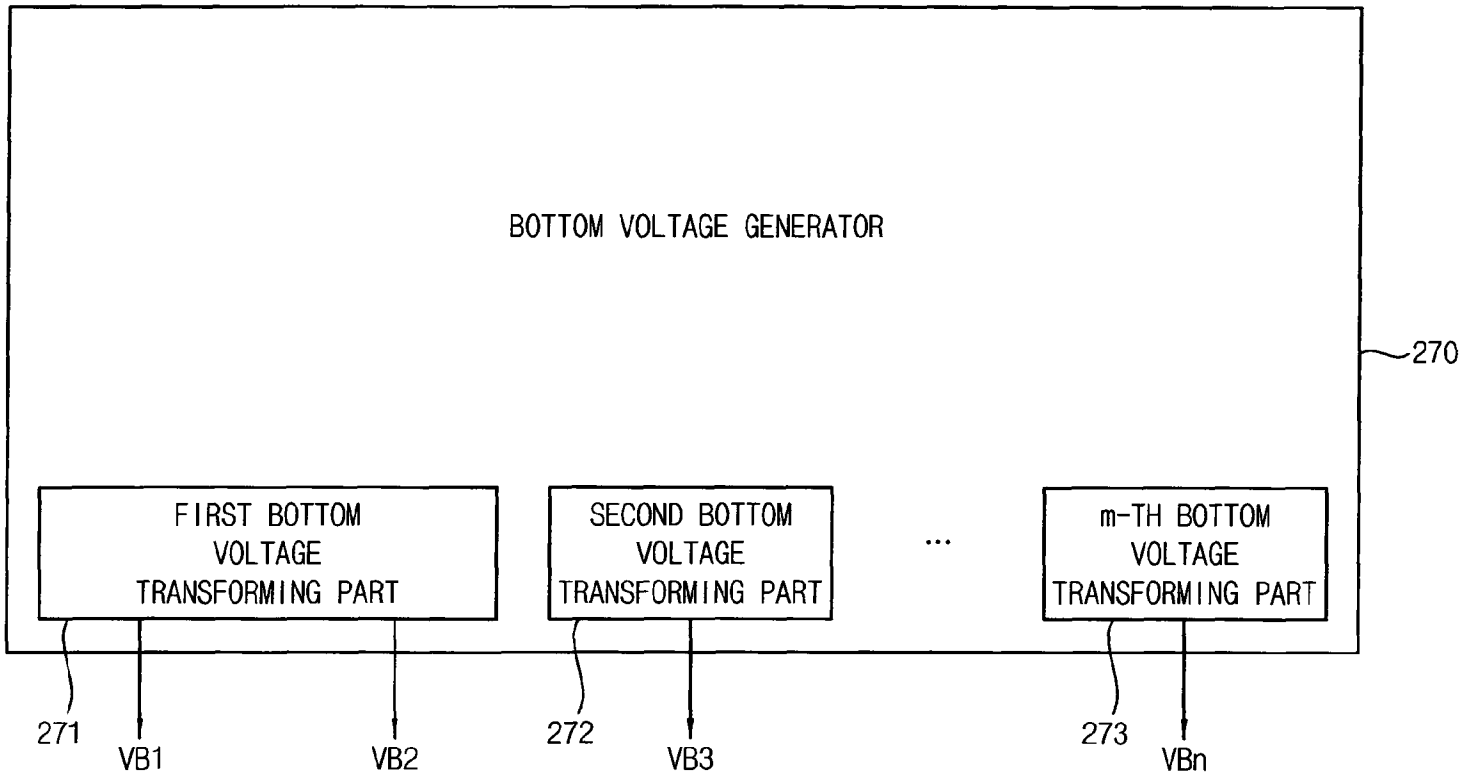
FIG. 9 is a block diagram illustrating an exemplary embodiment of a bottom voltage generator of FIG. 7.

FIG. 6 is a block diagram illustrating an alternative exemplary embodiment of a timing controller according to the invention. FIG. 7 is a block diagram illustrating an exemplary embodiment of a data driver and a transmitting part of FIG. 6. FIG. 8 is a block diagram illustrating an exemplary embodiment of a top voltage generator of FIG. 7. FIG. 9 is a block diagram illustrating an exemplary embodiment of a bottom voltage generator of FIG. 7.

The display apparatus shown in FIGS. 1, 2 and 6 to 9 is substantially the same as the display apparatus in FIGS. 1 to 5 except for a top voltage generator 260 and a bottom voltage generator 270 of a timing controller 201. The same or like elements shown in FIGS. 6 to 9 have been labeled with the same reference characters as used above to describe the exemplary embodiments of the display apparatus shown in FIGS. 3 to 5, and any repetitive detailed description thereof will hereinafter be omitted or simplified.

Referring to FIGS. 1, 2 and 6 to 9, an exemplary embodiment of a display apparatus includes a display panel 100 and a panel driver. The panel driver includes a timing controller 201, a gate driver 300, a gamma reference voltage generator 400 and a data driver 500.

The timing controller 201 receives input image data RGB and an input control signal CONT from an external apparatus (not shown).

The timing controller 201 generates a first control signal CONT1, a second control signal CONT2, a third control signal CONT3 and a data signal DATA based on the input image data RGB and the input control signal CONT.

The timing controller 201 includes a transmitting part 211.

The transmitting part 211 may include a top voltage generator 260, a bottom voltage generator 270, a first transmitting terminal 251, a second transmitting terminal 252 and a third transmitting terminal 253 to an n-th transmitting terminal 254. The transmitting part 211 may be connected to the data driving chips of the data driver 500 in a point-to-point method. Thus, the number of transmitting terminals in the transmitting part 211 is the same as the data driving chips.

The first transmitting terminal 251 may generate a first data signal DATA1 based on a first top voltage VT1 and a first bottom voltage VB1. The first transmitting terminal 251 may output the first data signal DATA1 to the first data driving chip 501.

The second transmitting terminal 252 may generate a second data signal DATA2 based on a second top voltage VT2 and a second bottom voltage VB2. The second transmitting terminal 252 may output the second data signal DATA2 to the second data driving chip 502.

The third transmitting terminal 253 may generate a third data signal DATA3 based on a third top voltage VT3 and a third bottom voltage VB3. The third transmitting terminal 253 may output the third data signal DATA3 to the third data driving chip 503.

The n-th transmitting terminal 254 may generate an n-th data signal DATAn based on an n-th top voltage VTn and an n-th bottom voltage VBn. The n-th transmitting terminal 254 may output the n-th data signal DATAn to the n-th data driving chip 504.

In an exemplary embodiment, referring to FIG. 7, a first wire connects the first transmitting terminal 251 to the first data driving chip 501. A second wire connects the second transmitting terminal 252 to the second data driving chip 502. In an exemplary embodiment, a length of the first wire is substantially the same as a length of the second wire. In an alternative exemplary embodiment, the length of the first wire is different from the length of the second wire, and a first resistance between first transmitting terminal 251 and the first data driving chip 501 is substantially the same as a second resistance between the second transmitting terminal 252 and the second data driving chip 502. Thus, in such an embodiment, a level of the first top voltage VT1 applied to the first transmitting terminal 251 is substantially the same as a level of the second top voltage VT2 applied to the second transmitting terminal 252. In such an embodiment, a level of the first bottom voltage VB1 applied to the first transmitting terminal 251 is substantially the same as a level of the second bottom voltage VB2 applied to the second transmitting terminal 252.

In an exemplary embodiment, a third wire connects the third transmitting terminal 253 to the third data driving chip 503. A length of the third wire is different from the length of the first wire and the length of the second wire. Thus, a third resistance between the third transmitting terminal 253 and the third data driving chip 503 is different from the first resistance and the second resistance. Thus, a level of the third top voltage VT3 applied to the third transmitting terminal 253 is different from the level of the first top voltage VT1 and the level of the second top voltage VT2. In such an embodiment, a level of the third bottom voltage VB3 applied to the third transmitting terminal 253 is different from the level of the first bottom voltage VB1 and the level of the second bottom voltage VB2.

A relation between the first to third transmitting terminals 251 to 253, the first to third data driving chips 501 to 503, the first to third top voltages VT1 to VT3, and the first to third bottom voltages VB1 to VB3 may be applied to a relation among other transmitting terminals and data driving chips.

In an exemplary embodiment, as shown in FIG. 8, the top voltage generator 260 includes a first top voltage transforming part 261, a second top voltage transforming part 262 to a m-th top voltage transforming part 263 (here, m is a natural number less than n).

In an exemplary embodiment, as shown in FIG. 8, the top voltage generator 260 includes the top voltage transforming parts, the number of which is less than the number of the top voltage transforming parts in the exemplary embodiment of the top voltage generator 220 illustrated in FIGS. 1 to 5.

The top voltage generator 260 may receive a first input voltage V1 from a power supplier (not shown). The top voltage generator 260 may generate and output the first top voltage VT1, the second top voltage VT2, the third top voltage VT3 to the n-th top voltage VTn based on the first input voltage V1.

In one exemplary embodiment, for example, the first top voltage transforming part 261 may generate the first top voltage VT1 and the second top voltage VT2 based on the first input voltage V1. The first top voltage transforming part 261 may output the first top voltage VT1 to the first transmitting terminal 251. The first top voltage transforming part 261 may output the second top voltage VT2 to the second transmitting terminal 252. The second top voltage transforming part 262 may generate the third top voltage VT3 based on the first input voltage V1, and output the third top voltage VT3 to the third transmitting terminal 253. The m-th top voltage transforming part 263 may generate the n-th top voltage VTn based on the first input voltage V1, and output the n-th top voltage VTn to the n-th transmitting terminal 254.

In an exemplary embodiment, a level of the first top voltage VT1 may be substantially the same as a level of the second top voltage VT2, and a level of the third top voltage VT3 may be greater than the level of the first top voltage VT1 and the level of the second top voltage VT2. Alternatively, the level of the first top voltage VT1 may be substantially the same as a level of the second top voltage VT2, and the level of the third top voltage VT3 may be less than the level of the first top voltage VT1 and the level of the second top voltage VT2.

A relation between the first top voltage transforming part 261 and the second top voltage transforming part 262 may be applied to a relation between other top voltage transforming parts.

In an exemplary embodiment, as shown in FIG. 9, the bottom voltage generator 270 may include a first bottom voltage transforming part 271, a second bottom voltage transforming part 272 to an m-th bottom voltage transforming part 273.

In such an embodiment, the bottom voltage generator 270 includes the bottom voltage transforming parts, the number of which is less than the number of the bottom voltage transforming parts in the exemplary embodiment of the bottom voltage generator 230 illustrated in FIGS. 1 to 5.

The bottom voltage generator 270 may receive a second input voltage V2 from the power supplier. The bottom voltage generator 270 may generate and output the first bottom voltage VB1, the second bottom voltage VB2, the third bottom voltage VB3 to n-th bottom voltage VBn based on the second input voltage V2.

In one exemplary embodiment, for example, the first bottom voltage transforming part 271 may generate the first bottom voltage VB1 and the second bottom voltage VB2 based on the second input voltage V2. The first bottom voltage transforming part 271 may output the first bottom voltage VB1 to the first transmitting terminal 251. The first bottom voltage transforming part 271 may output the second bottom voltage VB2 to the second transmitting terminal 252. The second bottom voltage transforming part 272 may generate the third bottom voltage VB3 based on the second input voltage V2, and output the third bottom voltage VB3 to the third transmitting terminal 253. The m-th bottom voltage transforming part 273 may generate the n-th bottom voltage VBn based on the second input voltage V2, and output the n-th bottom voltage VBn to the n-th transmitting terminal 254.

In an exemplary embodiment, a level of the first bottom voltage VB1 may be substantially the same as a level of the second bottom voltage VB2, and a level of the third bottom voltage VB3 may be greater than the level of the first bottom voltage VB1 and the level of the second bottom voltage VB2. Alternatively, the level of the first bottom voltage VB1 may be substantially the same as a level of the second bottom voltage VB2, and the level of the third bottom voltage VB3 may be less than the level of the first bottom voltage VB1 and the level of the second bottom voltage VB2.

A relation between the first bottom voltage transforming part 271 and the second bottom voltage transforming part 272 may be applied to a relation between other bottom voltage transforming parts.

Hereinafter, another alternative exemplary embodiment of the display apparatus will be described with reference to FIGS. 1, 2 and 10.

Figure 10:
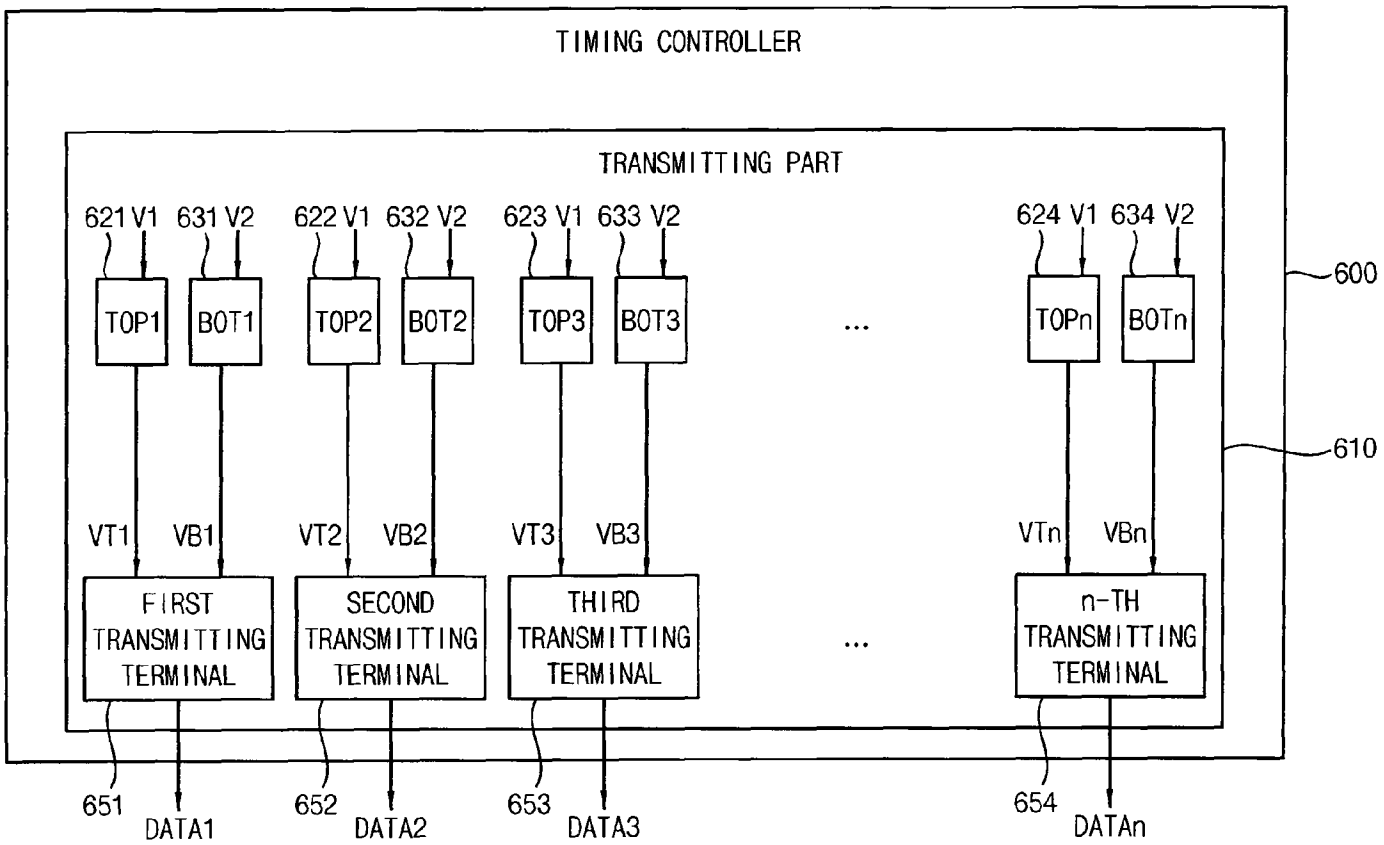
FIG. 10 is a block diagram illustrating another alternative exemplary embodiment of a timing controller according to the invention.

FIG. 10 is a block diagram illustrating another alternative exemplary embodiment of a timing controller according to the invention.

The display apparatus shown in FIGS. 1, 2 and 10 is substantially the same as the display apparatus in FIGS. 1 to 5 except for a transmitting part 610 of a timing controller 600. The same or like elements shown in FIG. 10 have been labeled with the same reference characters as used above to describe the exemplary embodiments of the display apparatus shown in FIGS. 1 to 5, and any repetitive detailed description thereof will hereinafter be omitted or simplified.

Referring to FIGS. 1, 2 and 10, an exemplary embodiment of the display apparatus includes a display panel 100 and a panel driver. The panel driver includes a timing controller 600, a gate driver 300, a gamma reference voltage generator 400 and a data driver 500.

The timing controller 600 receives input image data RGB and an input control signal CONT from an external apparatus (not shown).

The timing controller 600 generates a first control signal CONT1, a second control signal CONT2, a third control signal CONT3 and a data signal DATA based on the input image data RGB and the input control signal CONT.

The timing controller 600 includes a transmitting part 610.

The transmitting part 610 may include a first top voltage generator 621, a second top voltage generator 622, a third top voltage generator 623 to an n-th top voltage generator 624, a first bottom voltage generator 631, a second bottom voltage generator 632, a third bottom voltage generator 633 to an n-th bottom voltage generator 634, a first transmitting terminal 651, a second transmitting terminal 652 and a third transmitting terminal 653 to an n-th transmitting terminal 654. The transmitting part 610 may be connected to the data driving chips of the data driver 500 in a point-to-point method. Thus, the number of the transmitting terminals in the transmitting part 610 is the same as the number of the data driving chips.

The first transmitting terminal 651 may generate a first data signal DATA1 based on a first top voltage VT1 and a first bottom voltage VB1. The first transmitting terminal 651 may output the first data signal DATA1 to the first data driving chip 501.

The second transmitting terminal 652 may generate a second data signal DATA2 based on a second top voltage VT2 and a second bottom voltage VB2. The second transmitting terminal 652 may output the second data signal DATA2 to the second data driving chip 502.

The third transmitting terminal 653 may generate a third data signal DATA3 based on a third top voltage VT3 and a third bottom voltage VB3. The third transmitting terminal 653 may output the third data signal DATA3 to the third data driving chip 503.

The n-th transmitting terminal 654 may generate an n-th data signal DATAn based on an n-th top voltage VTn and an n-th bottom voltage VBn. The n-th transmitting terminal 654 may output the n-th data signal DATAn to the n-th data driving chip 504.

In an exemplary embodiment, as shown in FIG. 10, the transmitting part 610 includes the first to n-th top voltage generators 621 to 624 corresponding to the first to n-th top voltages VT1 to VTn. Thus, the number of the top voltage generators of the transmitting part 610 is substantially the same as the number of the transmitting terminals.

Each of the first to n-th top voltage generators 621 to 624 may receive a first input voltage V1 from a power supplier (not shown).

The first top voltage generator 621 may generate the first top voltage VT1 based on the first input voltage V1, and output the first top voltage VT1 to the first transmitting terminal 651.

The second top voltage generator 622 may generate the second top voltage VT2 based on the first input voltage V1, and output the second top voltage VT2 to the second transmitting terminal 652.

The third top voltage generator 623 may generate the third top voltage VT2 based on the first input voltage V1, and output the third top voltage VT3 to the third transmitting terminal 653.

The n-th top voltage generator 624 may generate the n-th top voltage VTn based on the first input voltage V1, and output the n-th top voltage VTn to the n-th transmitting terminal 654.

In such an embodiment, levels of the first to n-th top voltages VT1 to VTn may be different from each other. In an exemplary embodiment, each of the first to n-th top voltages VT1 to VTn may have a digital value corresponding to a level thereof.

In an exemplary embodiment, as shown in FIG. 10, the transmitting part 610 includes the first to n-th bottom voltage generators 631 to 634 corresponding to the first to n-th bottom voltages VB1 to VBn. Thus, the number of the bottom voltage generators of the transmitting part 610 is substantially the same as the number of the transmitting terminals.

Each of the first to n-th bottom voltage generators 631 to 634 may receive a second input voltage V2 from the power supplier.

The first bottom voltage generator 631 may generate the first bottom voltage VB1 based on the second input voltage V2, and output the first bottom voltage VB1 to the first transmitting terminal 651.

The second bottom voltage generator 632 may generate the second bottom voltage VB2 based on the second input voltage V2, and output the second bottom voltage VB2 to the second transmitting terminal 652.

The third bottom voltage generator 633 may generate the third bottom voltage VB2 based on the second input voltage V2, and output the third bottom voltage VB3 to the third transmitting terminal 653.

The n-th bottom voltage generator 634 may generate the n-th bottom voltage VBn based on the second input voltage V2, and output the n-th bottom voltage VBn to the n-th transmitting terminal 654.

In such an embodiment, levels of the first to n-th bottom voltages VB1 to VBn may be different from each other. In such an embodiment, each of the first to n-th bottom voltages VB1 to VBn may have a digital value corresponding to a level thereof.

Hereinafter, another alternative exemplary embodiment of the display apparatus will be described with reference to FIGS. 1, 2, 11 and 12.

Figure 11:
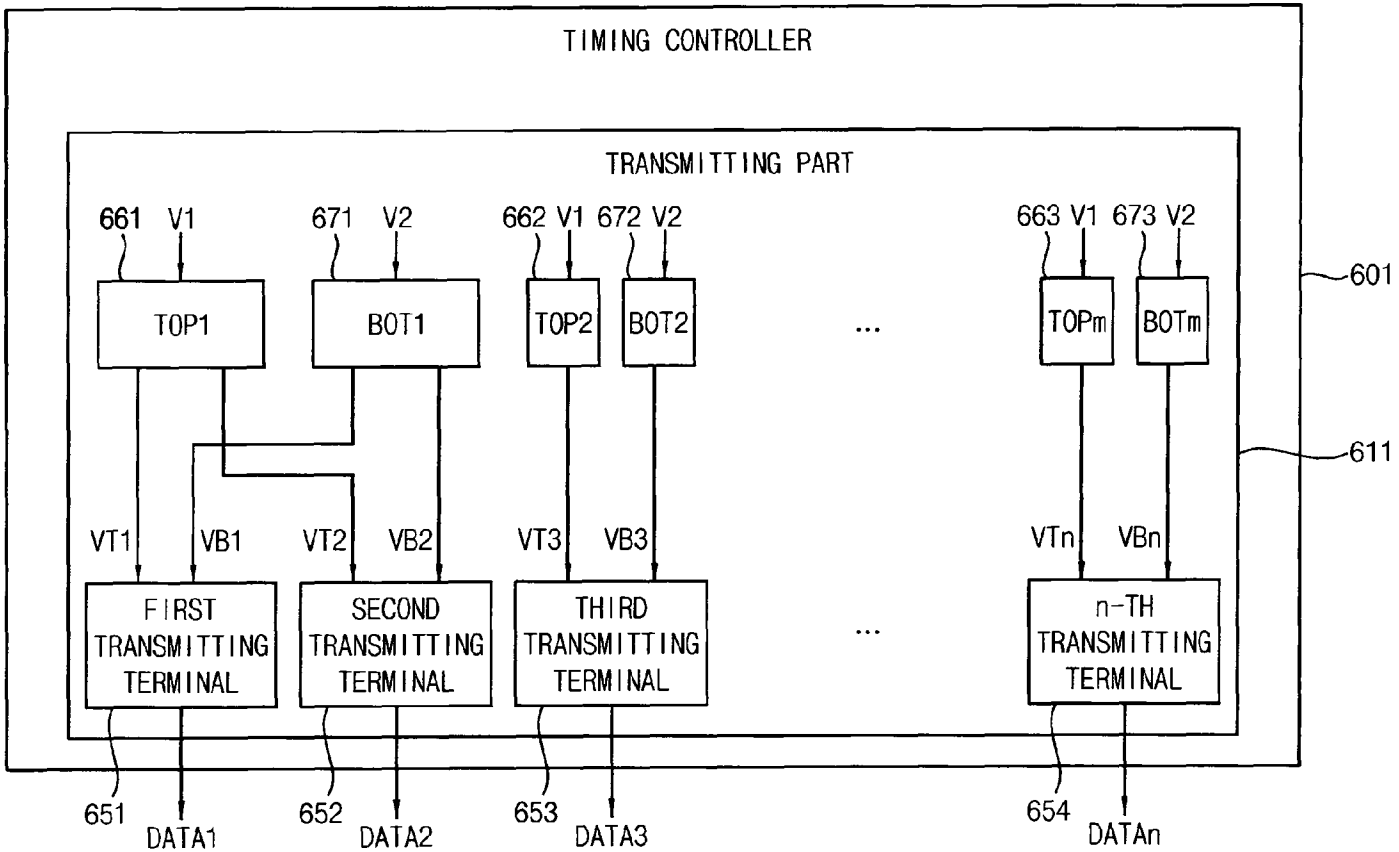
FIG. 11 is a block diagram illustrating another alternative exemplary embodiment of a timing controller according to the invention.
Figure 12:
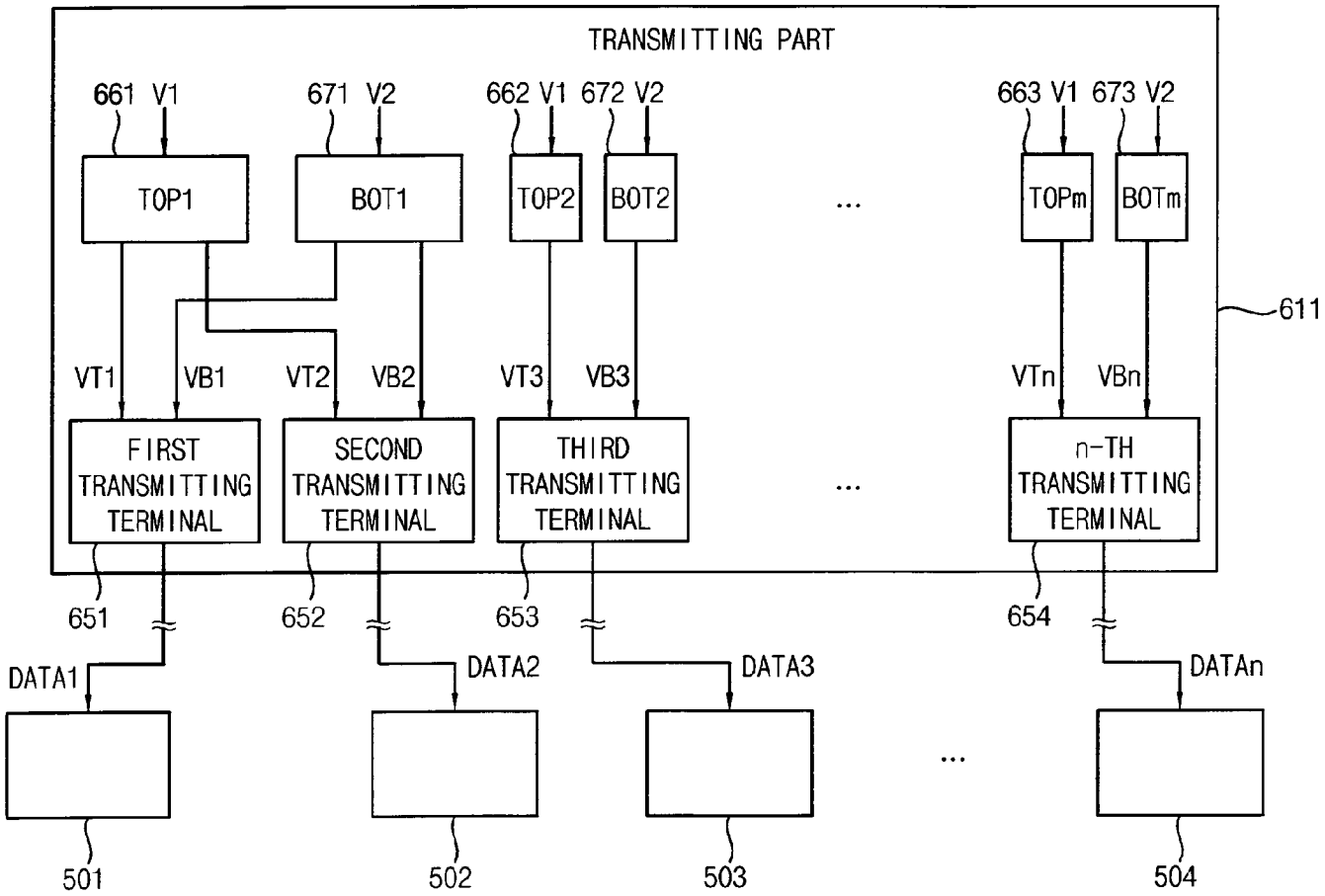
FIG. 12 is a block diagram illustrating an exemplary embodiment of a data driver and a transmitting part of FIG. 11.

FIG. 11 is a block diagram illustrating another alternative exemplary embodiment of a timing controller according to the invention. FIG. 12 is a block diagram illustrating an exemplary embodiment of a data driver and a transmitting part of FIG. 11.

The display apparatus shown in FIGS. 1, 2, 11 and 12 is substantially the same as the display apparatus in FIG. 10 except for a transmitting part 611 of a timing controller 601. The same or like elements shown in FIGS. 11 and 12 have been labeled with the same reference characters as used above to describe the exemplary embodiments of the display apparatus shown in FIGS. 1 to 5, and any repetitive detailed description thereof will hereinafter be omitted or simplified.

Referring to FIGS. 1, 2, 11 and 12, an exemplary embodiment of the display apparatus includes a display panel 100 and a panel driver. The panel driver includes a timing controller 601, a gate driver 300, a gamma reference voltage generator 400 and a data driver 500.

The timing controller 601 receives input image data RGB and an input control signal CONT from an external apparatus (not shown).

The timing controller 601 generates a first control signal CONT1, a second control signal CONT2, a third control signal CONT3 and a data signal DATA based on the input image data RGB and the input control signal CONT.

The timing controller 601 includes a transmitting part 611.

The transmitting part 611 may include a first top voltage generator 661, a second top voltage generator 662 to an m-th top voltage generator 663, a first bottom voltage generator 671, a second bottom voltage generator 672 to an n-th bottom voltage generator 673, a first transmitting terminal 651, a second transmitting terminal 652 and a third transmitting terminal 653 to an n-th transmitting terminal 654. The transmitting part 611 may be connected to the data driving chips of the data driver 500 in a point-to-point method. Thus, the number of the transmitting terminals in the transmitting part 611 may be the same as the number of the data driving chips.

The first transmitting terminal 651 may generate a first data signal DATA1 based on a first top voltage VT1 and a first bottom voltage VB1. The first transmitting terminal 651 may output the first data signal DATA1 to the first data driving chip 501.

The second transmitting terminal 652 may generate a second data signal DATA2 based on a second top voltage VT2 and a second bottom voltage VB2. The second transmitting terminal 652 may output the second data signal DATA2 to the second data driving chip 502.

The third transmitting terminal 653 may generate a third data signal DATA3 based on a third top voltage VT3 and a third bottom voltage VB3. The third transmitting terminal 653 may output the third data signal DATA3 to the third data driving chip 503.

The n-th transmitting terminal 654 may generate an n-th data signal DATAn based on an n-th top voltage VTn and an n-th bottom voltage VBn. The n-th transmitting terminal 654 may output the n-th data signal DATAn to the n-th data driving chip 504.

In an exemplary embodiment, referring to FIG. 12, a first wire connects the first transmitting terminal 651 to the first data driving chip 501. A second wire connects the second transmitting terminal 652 to the second data driving chip 502. In such an embodiment, a length of the first wire may be substantially the same as a length of the second wire. In an alternative exemplary embodiment, where the length of the first wire is different from the length of the second wire, a first resistance between the first transmitting terminal 651 and the first data driving chip 501 is substantially the same as a second resistance between the second transmitting terminal 652 and the second data driving chip 502. Thus, in such an embodiment, a level of the first top voltage VT1 applied to the first transmitting terminal 651 is substantially the same as a level of the second top voltage VT2 applied to the second transmitting terminal 652, and a level of the first bottom voltage VB1 applied to the first transmitting terminal 651 is substantially the same as a level of the second bottom voltage VB2 applied to the second transmitting terminal 652.

In such an embodiment, a third wire connects the third transmitting terminal 653 to the third data driving chip 503. A length of the third wire may be different from the length of the first wire and the length of the second wire. Thus, a third resistance between the third transmitting terminal 653 and the third data driving chip 503 is different from the first resistance and the second resistance. Thus, a level of the third top voltage VT3 applied to the third transmitting terminal 653 is different from the level of the first top voltage VT1 and the level of the second top voltage VT2, and a level of the third bottom voltage VB3 applied to the third transmitting terminal 653 is different from the level of the first bottom voltage VB1 and the level of the second bottom voltage VB2.

A relation among the first to third transmitting terminals 651 to 653, the first to third data driving chips 501 to 503, the first to third top voltages VT1 to VT3, and the first to third bottom voltages VB1 to VB3 may be applied to a relation among other transmitting terminals and other data driving chips.

In such an embodiment, as shown in FIG. 12, the transmitting part 611 may include the top voltage generators, the number of which is less than the number of the top voltage generators of the transmitting part 610 in the exemplary embodiment illustrated in FIG. 10.

In such an embodiment, each of the first to m-th top voltage generators 661 to 663 may receive a first input voltage V1 from a power supplier.

The first top voltage generator 661 may generate the first top voltage VT1 and the second top voltage VT2 based on the first input voltage V1. The first top voltage generator 661 may output the first top voltage VT1 to the first transmitting terminal 651. The first top voltage generator 661 may output the second top voltage VT3 to the second transmitting terminal 652.

The second top voltage generator 662 may generate the third top voltage VT3 based on the first input voltage V1, and output the third top voltage VT3 to the third transmitting terminal 653.

The m-th top voltage generator 663 may generate the n-th top voltage VTn based on the first input voltage V1, and output the n-th top voltage VTn to the n-th transmitting terminal 654.

In such an embodiment, a level of the first top voltage VT1 may be substantially the same as a level of the second top voltage VT2, and a level of the third top voltage VT3 may be greater than the level of the first top voltage VT1 and the level of the second top voltage VT2. Alternatively, the level of the first top voltage VT1 may be substantially the same as a level of the second top voltage VT2, and the level of the third top voltage VT3 may be less than the level of the first top voltage VT1 and the level of the second top voltage VT2.

A relation between the first top voltage generator 661 and the second top voltage generator 662 may be applied to a relation between other top voltage transforming parts.

In such an embodiment, as shown in FIG. 12, the transmitting part 611 includes the bottom voltage generators, the number of which is less than the number of the bottom voltage generators of the transmitting part 610 in the exemplary embodiment illustrated in FIG. 10.

Each of the first to m-th bottom voltage generators 671 to 673 may receive a second input voltage V2 from the power supplier.

The first bottom voltage generator 671 may generate the first bottom voltage VB1 and the second bottom voltage VB2 based on the second input voltage V2. The first bottom voltage generator 671 may output the first bottom voltage VB1 to the first transmitting terminal 651. The first bottom voltage generator 671 may output the second bottom voltage VB3 to the second transmitting terminal 652.

The second bottom voltage generator 672 may generate the third bottom voltage VB3 based on the second input voltage V2, and output the third bottom voltage VB3 to the third transmitting terminal 653.

The m-th bottom voltage generator 663 may generate the n-th bottom voltage VBn based on the second input voltage V2, and output the n-th bottom voltage VBn to the n-th transmitting terminal 654.

In an exemplary embodiment, a level of the first bottom voltage VB1 may be substantially the same as a level of the second bottom voltage VB2, and a level of the third bottom voltage VB3 may be greater than the level of the first bottom voltage VB1 and the level of the second bottom voltage VB2. Alternatively, the level of the first bottom voltage VB1 may be substantially the same as a level of the second bottom voltage VB2, and the level of the third bottom voltage VB3 may be less than the level of the first bottom voltage VB1 and the level of the second bottom voltage VB2.

A relation between the first bottom voltage generator 671 and the second BOTTOM voltage generator 672 may be applied to a relation between other bottom voltage transforming parts.

According to exemplary embodiments, as described herein, where the timing controller and a plurality of the data driving chips are connected in a point-to-point method, when distances between the timing controller and the data driving chips are different from each other, the timing controller may individually provide a power corresponding to the data driving chips. Thus, in such embodiments, power consumption decreases and noise decreases. In such embodiments, as the noise decreases, the display quality of a display apparatus may be improved.

Exemplary embodiments of a timing controller described herein may be applied to a mobile type display apparatus such as a mobile phone, a laptop computer and a tablet computer, a fixed type display such as a television and a desktop display, and a display of a general appliance such as a refrigerator, a washing machine and an air conditioner, but not being limited thereto.

The foregoing is illustrative of the invention and is not to be construed as limiting thereof. Although some exemplary embodiments of the invention have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. Therefore, it is to be understood that the foregoing is illustrative of the invention and is not to be construed as limited to the specific exemplary embodiments disclosed, and that modifications to the disclosed exemplary embodiments, as well as other exemplary embodiments, are intended to be included within the scope of the appended claims. The invention is defined by the following claims, with equivalents of the claims to be included therein.

What is claimed is:

1. A timing controller of a display apparatus, the timing controller comprising:

a top voltage generator configured to output a first top voltage, a second top voltage and a third top voltage, wherein one of the first to third top voltages is different from another of the first to third top voltages;

a bottom voltage generator configured to output a first bottom voltage, a second bottom voltage and a third bottom voltage, wherein one of the first to third bottom voltages is different from another of the first to third bottom voltages;

a first transmitting terminal configured to output a first data signal based on the first top voltage and the first bottom voltage, wherein the first data signal is applied to a first data driving chip of the display apparatus;

a second transmitting terminal configured to output a second data signal based on the second top voltage and the second bottom voltage, wherein the second data signal is applied to a second data driving chip of the display apparatus; and a third transmitting terminal configured to output a third data signal based on the third top voltage and the third bottom voltage, wherein the third data signal is applied to a third data driving chip of the display apparatus.

2. The timing controller of claim 1, wherein the top voltage generator is configured to receive a first input voltage, and the top voltage generator comprises:

a first top voltage transforming part configured to generate the first top voltage based on the first input voltage;

a second top voltage transforming part configured to generate the second top voltage based on the first input voltage; and a third top voltage transforming part configured to generate the third top voltage based on the first input voltage.

3. The timing controller of claim 2, wherein the bottom voltage generator is configured to receive a second input voltage, and the bottom voltage generator comprises:

a first bottom voltage transforming part configured to generate the first bottom voltage based on the second input voltage;

a second bottom voltage transforming part configured to generate the second bottom voltage based on the second input voltage; and a third bottom voltage transforming part configured to generate the third bottom voltage based on the second input voltage.

4. The timing controller of claim 1, wherein the top voltage generator is configured to receive a first input voltage, and the top voltage generator comprises:

a first top voltage transforming part configured to generate the first top voltage and the second top voltage based on the first input voltage; and a second top voltage transforming part configured to generate the third top voltage based on the first input voltage, wherein a level of the first top voltage is substantially the same as a level of the second top voltage, and a level of the third top voltage is different from the level of the first top voltage and the level of the second top voltage.

5. The timing controller of claim 4, wherein the bottom voltage generator is configured to receive a second input voltage, and the bottom voltage generator comprises:

a first bottom voltage transforming part configured to generate the first bottom voltage and the second bottom voltage based on the second input voltage; and a second bottom voltage transforming part configured to generate the third bottom voltage based on the second input voltage, wherein a level of the first bottom voltage is substantially the same as a level of the second bottom voltage, and a level of the third bottom voltage is different from the level of the first bottom voltage and the level of the second bottom voltage.

6. The timing controller of claim 1, wherein each of the first, second and third top voltage has a digital value, and each of the first, second and third bottom voltage has a digital value.

7. A display apparatus comprising:

a display panel configured to display an image, wherein the display panel comprises a substrate and data lines disposed on the substrate;

a timing controller comprising:

a top voltage generator configured to output a first top voltage, a second top voltage and a third top voltage, wherein one of the first to third top voltages is different from another of the first to third top voltages;

a bottom voltage generator configured to output a first bottom voltage, a second bottom voltage and a third bottom voltage, wherein one of the first to third bottom voltages is different from another of the first to third bottom voltages;

a first transmitting terminal configured to output a first data signal based on the first top voltage and the first bottom voltage;

a second transmitting terminal configured to output a second data signal based on the second top voltage and the second bottom voltage; and a third transmitting terminal configured to output a third data signal based on the third top voltage and the third bottom voltage; and a data driver configured to provide data voltages to the data lines, wherein the data driver comprises a first data driving chip, a second data driving chip and a third data driving chip, wherein the first data driving chip is disposed on the substrate and is configured to receive the first data signal, the second data driving chip is disposed on the substrate and is configured to receive the second data signal, and the third data driving chip is disposed on the substrate and is configured to receive the third data signal.

8. The display apparatus of claim 7, wherein the top voltage generator is configured to receive a first input voltage, and the top voltage generator comprises:

a first top voltage transforming part configured to generate the first top voltage based on the first input voltage;

a second top voltage transforming part configured to generate the second top voltage based on the first input voltage; and a third top voltage transforming part configured to generate the third top voltage based on the first input voltage.

9. The display apparatus of claim 7, wherein the bottom voltage generator is configured to receive a second input voltage, and the bottom voltage generator comprises:

a first bottom voltage transforming part configured to generate the first bottom voltage based on the second input voltage;

a second bottom voltage transforming part configured to generate the second bottom voltage based on the second input voltage; and a third bottom voltage transforming part configured to generate the third bottom voltage based on the second input voltage.

10. The display apparatus of claim 7, wherein the top voltage generator is configured to receive a first input voltage, and the top voltage generator comprises:

a first top voltage transforming part configured to generate the first top voltage and the second top voltage based on the first input voltage; and a second top voltage transforming part configured to generate the third top voltage based on the first input voltage, wherein a level of the first top voltage is substantially the same as a level of the second top voltage, and a level of the third top voltage is different from the level of the first top voltage and the level of the second top voltage.

11. The display apparatus of claim 10, wherein the bottom voltage generator is configured to receive a second input voltage, and the bottom voltage generator comprises:

a first bottom voltage transforming part configured to generate the first bottom voltage and the second bottom voltage based on the second input voltage; and a second bottom voltage transforming part configured to generate the third bottom voltage based on the second input voltage, wherein a level of the first bottom voltage is substantially the same as a level of the second bottom voltage, and a level of the third bottom voltage is different from the level of the first bottom voltage and the level of the second bottom voltage.

12. The display apparatus of claim 10, further comprising:

a first wire configured to electrically connect the first transmitting terminal to the first data driving chip;

a second wire configured to electrically connect the second transmitting terminal to the second data driving chip; and a third wire configured to electrically connect the third transmitting terminal to the third data driving chip, wherein a length of the first wire is substantially the same as a length of a second wire, and a length of the third wire is different from the length of the first wire.

13. The display apparatus of claim 7, wherein each of the first, second and third top voltage has a digital value, and each of the first, second and third bottom voltage has a digital value.

14. A display apparatus comprising:

a display panel configured to display an image, wherein the display panel comprises a substrate and data lines disposed on the substrate;

a timing controller comprising:

a first top voltage generator configured to output a first top voltage;

a second top voltage generator configured to output a second top voltage having a different level from the first top voltage;

a first bottom voltage generator configured to output a first bottom voltage;

a second bottom voltage generator configured to output a second bottom voltage having a different level from the first bottom voltage;

a first transmitting terminal configured to output a first data signal based on the first top voltage and the first bottom voltage; and a second transmitting terminal configured to output a second data signal based on the second top voltage and the second bottom voltage; and a data driver configured to provide data voltages to the data lines, wherein the data driver comprises a first data driving chip and a second data driving chip, wherein the first data driving chip is disposed on the substrate and is configured to receive the first data signal, and the second data driving chip is disposed on the substrate and is configured to receive the second data signal.

15. The display apparatus of claim 14, wherein the data driver further comprises a third data driving chip disposed on the substrate and configured to output the data voltages to the data lines, and the timing controller further comprises a third transmitting terminal configured to output a third data signal to the third data driving chip.

16. The display apparatus of claim 15, wherein the timing controller further comprises:

a third top voltage generator configured to output a third top voltage; and a third bottom voltage generator configured to output a third bottom voltage, wherein the third transmitting terminal is configured to output the third data signal to the third data driving chip based on the third top voltage and the third bottom voltage.

17. The display apparatus of claim 15, wherein the third transmitting terminal is configured to output the third data signal to the third data driving chip based on the first top voltage and the first bottom voltage.

18. The display apparatus of claim 17, further comprising:

a first wire configured to electrically connect the first transmitting terminal to the first data driving chip;

a second wire configured to electrically connect the second transmitting terminal to the second data driving chip; and a third wire configured to electrically connect the third transmitting terminal to the third data driving chip, wherein a length of the first wire is substantially the same as a length of the third wire, and a length of the second wire is different from the length of the first wire.

19. The display apparatus of claim 14, wherein each of the first and second top voltage has a digital value, and each of the first and second bottom voltage has a digital value.

* * * * *